US011306426B2

(12) United States Patent
Da Riol et al.

(10) Patent No.: US 11,306,426 B2
(45) Date of Patent: Apr. 19, 2022

(54) HOUSEHOLD APPLIANCE

(71) Applicant: Electrolux Appliances Aktiebolag, Stockholm (SE)

(72) Inventors: Daniele Da Riol, Porcia (IT); Dario Braconi, Porcia (IT); Mauro Cinello, Porcia (IT); Helena Romito, Porcia (IT)

(73) Assignee: Electrolux Appliances Aktiebolag

( * ) Notice: Subject to any disclaimer, the term of this patent is extended or adjusted under 35 U.S.C. 154(b) by 140 days.

(21) Appl. No.: 16/766,107

(22) PCT Filed: Nov. 8, 2018

(86) PCT No.: PCT/EP2018/080593
§ 371 (c)(1),
(2) Date: May 21, 2020

(87) PCT Pub. No.: WO2019/101532
PCT Pub. Date: May 31, 2019

(65) Prior Publication Data

US 2020/0362501 A1 Nov. 19, 2020

(30) Foreign Application Priority Data

Nov. 23, 2017 (EP) ..... 17203305

(51) Int. Cl.
*D06F 39/02* (2006.01)

(52) U.S. Cl.
CPC ..... *D06F 39/02* (2013.01)

(58) Field of Classification Search
CPC ..... D06F 39/02
See application file for complete search history.

(56) References Cited

FOREIGN PATENT DOCUMENTS

| | | | |
|---|---|---|---|
| CA | 2338146 | A1 | 8/2001 |
| CN | 200988915 | Y | 12/2007 |
| EP | 1449951 | A1 | 8/2004 |
| EP | 1842953 | A2 | 10/2007 |
| EP | 1449951 | B2 | 8/2011 |
| GB | 1211560 | | 11/1970 |
| KR | 20150121583 | A | 10/2015 |
| WO | 2017042228 | A1 | 3/2017 |

OTHER PUBLICATIONS

International Preliminary Report on Patentability for International Application No. PCT/EP2018/080593, dated May 26, 2020, 8 pages.
International Search Report and Written Opinion for International Application PCT/EP2018/080593, dated Dec. 10, 2018, 11 pages.
Chinese Office Action for Chinese Application No. 201880075162.8, dated Jan. 4, 2022, with translation, 17 pages.

*Primary Examiner* — Jason Y Ko
(74) *Attorney, Agent, or Firm* — RatnerPrestia

(57) ABSTRACT

A household appliance having a retractable drawer arranged in a drawer housing. The drawer has at least one sliding element slideably arranged on at least one guiding element provided on the drawer housing such that the sliding element and the guiding element provide respective contact surfaces for each other, whereby the guiding element and/or the sliding element has, at least in an area, recesses that reduce an area of the respective contact surface.

15 Claims, 12 Drawing Sheets

HOUSEHOLD APPLIANCE

This application is a U.S. National Phase application of PCT International Application No. PCT/EP2018/080593, filed Nov. 8, 2018, which claims the benefit of EP 17203305.2, filed Nov. 23, 2017, both of which are incorporated by reference herein.

FIELD OF THE INVENTION

The present invention concerns the field of household appliances, especially laundry treatment machines. In particular, the present invention refers to a laundry treatment machine with a drawer.

BACKGROUND ART

Nowadays the use of laundry treatment machines is widespread. Laundry treatment machines comprise both "simple" laundry washing machines (i.e. laundry washing machines which can only wash and rinse laundry) and laundry washing-drying machines (i.e. laundry washing machines which can also dry laundry), or drying machines (i.e. drying machines which can dry laundry).

In the present description, the term "laundry treatment machine" refers to simple laundry washing machines, laundry washing-drying machines or drying machines. Laundry treatment machines such as laundry washing machines generally comprise an external casing provided with a washing tub which contains a rotatable perforated drum where the laundry is placed. A loading/unloading door ensures access to the drum. Laundry treatment appliances typically comprise a water supply unit and a products supply unit, preferably a drawer, for the introduction of water and washing/rinsing products (i.e. detergent, softener, rinse conditioner, etc.) into the tub. Known laundry treatment appliances are also provided with water draining devices that may operate during different phases of the washing program to drain the dirty water.

According to the known art, a complete treating program typically includes different phases during which the laundry to be washed is subjected to adequate treatments. A treating cycle usually comprises a main washing phase during which the laundry is treated by means of water and a detergent. The water is typically heated to a predetermined temperature based on the washing program selected by the user. It is also possible that hot water is introduced into the tub from the hot water mains. During the main washing phase the drum is rotated, so as to apply also a mechanical cleaning action on the laundry. At the end of the main washing phase the drum is typically rotated at high rotational speed in such a way that dirty washing liquid (i.e. water mixed with detergent) is extracted from the laundry, and this dirty washing liquid is drained to the outside by the water draining devices.

A combined washer/dryer is built for washing and drying clothes and comprises a drying chamber into which the clothes to be dried are introduced. The drying chamber is rotatable supported within a cabinet and made to rotate by means of a driving motor, typically consisting of an electric motor connected to the drying chamber via a belt. The drying chamber usually is a drum, and one or more drying phases are added which typically commence after the washing phases. The drying phase usually involves rotating the drum and applying hot air to the laundry.

Household appliances, especially laundry treatment appliances, usually have a connection to water mains or to a water supply and comprise a water circuit into which water can be admitted through a water supply valve. Additionally or alternatively, further valve(s) can be provided configured to allow the water flow into this circuit, eventually and/or potentially into a branch of this circuit; for example, a discharge valve can be associated to a discharge circuit, allowing the discharge of the waste by the flowing of the water into a discharge circuit connected outside the machine.

The drawer is usually configured to be pulled out/extracted by the user in order to fill in detergent or other laundry treatment agents such as bleaching agent or softener. The drawer can slide inside/outside a housing to allow the detergent loading in the extracted position, and the normal functioning in the inserted position. The drawer is designed to have the lateral edges protruding; in association of these edges, two slots are provided on the housing so that the drawer is inserted/extracted through the sliding of the lateral edges on the respective slots.

The drawer is therefore constrained at the edges and the weight is fully concentrated on the sliding portion of said edges. This naturally increases the contact surface between the two parts and reduces the fluidity of movement during the opening/closing of the drawer itself. In addition to this natural consequence of this geometry, the contact surface could further increase due to deformations of the parts, burrs, etc. A large contact surface increases the friction between drawer and drawer housing and worsens the handling of the drawer. In order for the appliance to provide a reliable and convenient user experience, the drawer should be easy to handle/to move.

SUMMARY OF THE INVENTION

The aim of the invention is therefore to provide a household appliance in which the drawer can be handled with convenience and ease.

Another aim of the present invention is to provide an household appliance in which the sliding between the drawer and the housing is realized in an easier and cheaper way.

Another aim of the present invention is to decrease the friction between the slidable drawer and the housing in an easy and cheap way.

The invention therefore relates to a household appliance, comprising a retractable drawer arranged in a drawer housing, said drawer comprising at least one sliding element slideably arranged on at least one guiding element provided on drawer housing such that the sliding element and the guiding element provide respective contact surfaces for each other, whereby the guiding element and/or the sliding element comprises at least in a portion of said contact surface a roughness increased by recesses which reduces the respective contact surface.

Preferred embodiments of the invention are described in relation to the dependent claims and the description of the enclosed drawings.

The invention is based on the consideration that the handling of the drawer is a most prominent operation and should be convenient and comfortable. The effort required by the user to pull out or push the drawer depends, other than the weight of said drawer, on the contact surfaces between drawer and guiding parts on which the drawer is sliding. If the surface is too large, the friction between drawer and housing demands a large force for operating the drawer; on the other hand, if the area occupied by the contact surface is too much reduced, the smooth, linear, and precise sliding of the drawer along the guiding elements is affected.

Applicant has found that the handling and the movement of the drawer can be improved maintaining the area occupied by the usual contact surfaces necessary to assure a comfortable and precise sliding of the drawer, by reducing the contact surface, and consequently by reducing the coefficient of friction, between the sliding element and the guiding element through the modification of the roughness of said contact surface, creating a structural lubricity between drawer and housing.

The notion that the contact surface is reduced means that the surface in which the sliding element and the guiding element are in contact is smaller compared to the case where the recesses would not be present and the contact surface would essentially be flat and so, would correspond to the entire area occupied by said contact surface.

In other words, the concrete area of the contact surface which touches the other component is reduced in size compared to a flat surface, whereby flat essentially means that there are no recesses in the micrometer up to millimeter region.

The notion that the reduction of the contact surface through a roughness increasing means a reduction of the contact surface of a defined/fixed area/surface extension in which the sliding element and the guiding element are faced each other during the drawer sliding, through recesses provided on at least one of the respective contact surface, maintaining the original defined/fixed area/surface extension.

The notion that a roughness is increased on the contact surface preferably means that surface structures on the contact surface, especially grooves, are dimensioned, preferably have a width, between 50 μm and 2 mm.

The invention therefore is based on a reduction of contact surface to minimize the friction between the drawer and the housing. This reduction can be obtained through various methods, especially by a micromachining of the mould, a laser ablation of the mould, an introduction of some ribs on the housing. In all these cases, the aim is to obtain a microstructure on the contact surfaces, minimizing the friction between parts during the sliding. The same concepts can be applied to the drawer housing, the drawer or guides on which the drawer is slideably mounted.

The recesses are preferably arranged in a regular way/structure, i.e. they preferably have a constant distance to each other and/or are arranged in a regular grid. In this way, the sliding behavior of the drawer is constant over the entire sliding distance and the user has a predictable and comfortable experience.

Preferably, the recesses are only arranged on the respective guiding element. Thereby the contact surface of the guiding element is reduced in size compared to a flat case.

In a preferred embodiment, the recesses are at least partially built as grooves. Advantageously, the grooves are parallel disposed to each other; preferably the grooves are parallel disposed along the sliding direction of the drawer with respect to the drawer housing. A groove extends into the component and removes contact area from the surface, thereby reducing the contact area.

Advantageously, the grooves have a width between 50 μm and 2 mm.

Preferably, at least for a subset of the grooves, the respective groove has a rectangular, especially square, cross section.

Preferably, at least for a subset of the grooves, the respective groove cross section has parallel walls ending in a semi-circle. For example, the cross section can be designed as or resemble a U-shape.

Preferably, at least for a subset of the grooves, the respective groove has a triangular cross section.

The contact surface can thus comprise grooves which all have the same cross section. Alternatively, various groups of grooves can be provided, whereby the respective cross sections can be chosen differently, especially as described above.

Advantageously, at least in a region, recesses are built in such a way that a grid of micro-pillars is provided. These pillars preferably comprise a circular and/or a rectangular and/or hexagonal cross section. They can also comprise a round cross section. It is possible to have several groups of pillars with cross sections of different size and/or shape.

In a preferred embodiment, the guiding element provides two contact surfaces for a respective sliding element. In other embodiments, only one or three contact surfaces can be provided.

Advantageously, the household appliance comprises two groups of guide elements arranged on respective opposite sides of the drawer housing.

Advantageously, each group contains exactly one guiding element.

In a preferred variant, each group contains a plurality of spatially separated guiding elements. In this way, the contact surface is even further reduced in the gaps between the guiding elements because also the defined/fixed area/surface extension is reduced.

Preferably, the respective guiding element is part of the/integrated with the drawer housing.

Advantageously, the guiding element is arranged on a seat of the drawer housing.

The guiding element preferably comprises a C-like section with two parallel parts and a main part perpendicular to these parallel parts for receiving at least partly the sliding element.

Preferably, each parallel part on its side facing the sliding element of the drawer provides a contact surface.

Preferably the respective guiding element is made low friction material such as Polytetrafluoroethylene (PTFE), POM-C (Acetal Copolymer), poly(hexano-6-lactam) (PA6), and is preferably is bi-injected/insertion moulded on a thermoplastic component of the drawer housing; alternatively, it can be assembled by known connecting means, such as a snap connection, gluing, welding, etc.

In a preferred embodiment, the household appliance is built as a laundry treatment machine, especially a washer or combined washer/dryer. It especially can be built as a front-loading washing machine or washer/dryer. In an alternative preferred embodiment, the household appliance can be built as a refrigerating and/or freezing appliance.

The advantages of the invention are especially as follows. The reduced contact surface results in a good feeling of the user when opening/the drawer. No silicon oil is needed for lubrication, since no additional means or components are needed for reducing the friction between drawer and drawer housing.

BRIEF DESCRIPTION OF THE DRAWINGS

Further features and advantages of the present invention shall become clearer from the following detailed description of some of its preferred embodiments, made with reference to the attached schematic drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings:

In FIG. 1 a household appliance 2 is shown which is built as laundry treatment machine, in the example shown a front-loading washing machine and comprises housing or casing 6 with a preferable parallelepiped shape, the casing 6 comprising a front wall 10, two side walls 14, a cover plate 20 and a rear wall (not shown). Front wall 10 and side walls 14 are preferably part of a cabinet. A front door 24 is provided which can be opened for loading or unloading laundry through an opening 28 into a washing drum and which can be closed. Door 24 can be preferably operated, especially opened and closed, by a handle 26.

Advantageously a washing tub is contained within casing 6, whereby a rotatable and perforated drum is contained by the washing tub. Both washing tub and drum have a substantially cylindrical shape. Advantageously the tub is suspended in a floating manner inside casing 6 by means of a number of coil springs and shock absorbers. The drum is rotated by an electric motor, which transmits the rotating motion of a motor shaft to the drum by a belt/pulley system. In a different embodiment of the invention, the motor can be directly associated with the shaft of the drum. The tub is preferable connected to casing 6 by means of an elastic bellows or gasket. The tub preferably comprises two complementary hemi-shells structured for being reciprocally coupled to form tub. On front wall 10, preferably a service flap 8 is provided, preferably for accessing a filter unit. Alternatively, the laundry appliance can be a combined washer and dryer or a dryer, in the latter case the tub is preferably not provided.

Figure 1:
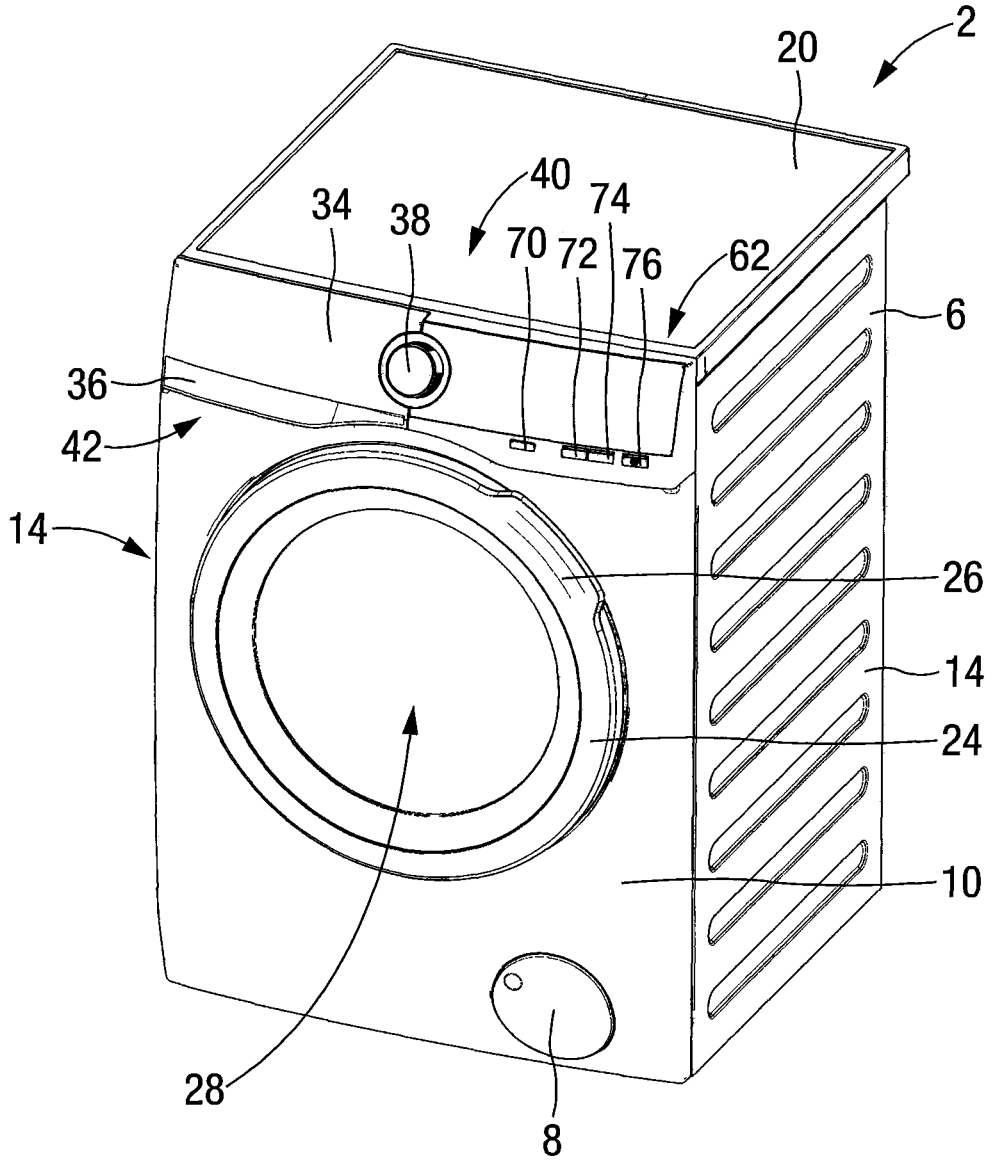
FIG. 1 shows a front-loading washing machine with an inserted drawer in a preferred embodiment in a perspective view.

The preferred washing machine shown in FIG. 1 on a front panel 40 comprises a drawer 42 with a front plate 34 and a handle 36 for pulling out and pushing back the drawer 42. Drawer 42, which is shown in a fully inserted state, comprises at least one compartment for receiving detergent or washing additives. In a dryer, the drawer can be built as or comprise a moisture container for collection of moisture which is separated from the drying laundry.

Adjacent to drawer 42, preferably a rotatable or rotary knob 38 is arranged for selecting a laundry treatment program and/or at least one parameter of a laundry treatment program. Preferably, knob 38 has also a push-functionality and can be pressed for selected and/or confirmation of selected options. Knob 38 is preferably provided on a control panel 62 which can provide further indicating and/or control elements 70, 72, 74. Knob 38 is preferably arranged on front panel 40 adjacent to drawer 42. On control panel 62, preferably a touch display is arranged. Laundry treatment machine 2 preferably comprises an ON/OFF button 76 for switching on or off the machine.

Figure 2:
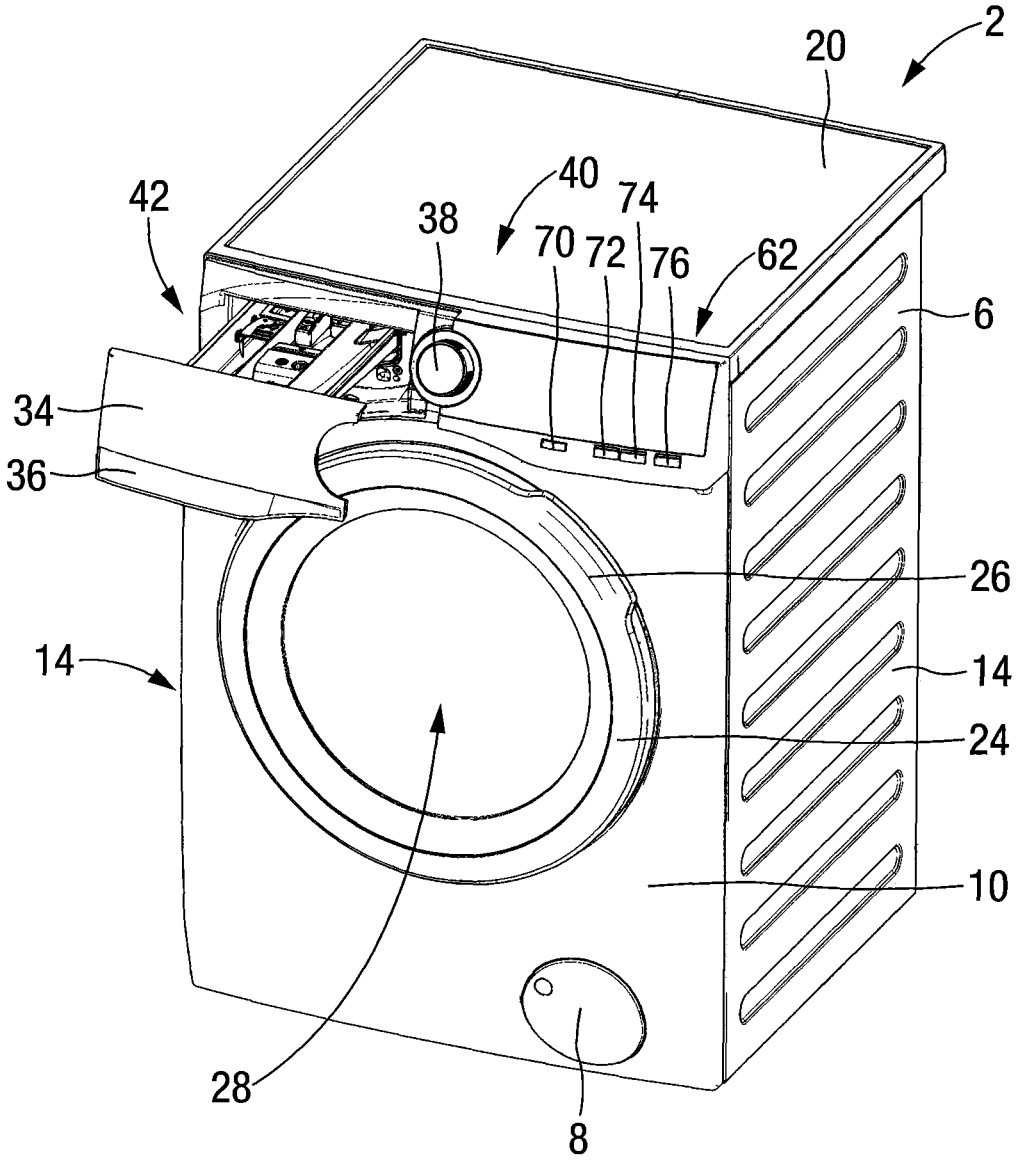
FIG. 2 shows the washing machine of FIG. 1 with the drawer in an extracted state.

FIG. 2 shows the laundry treatment machine 2 of FIG. 1 with the drawer 42 in an extracted state. The drawer 42 is pulled out/extracted for filling in at least one compartment of laundry treatment agent, especially detergent, bleaching agent, or softener. Drawer 42 comprises preferably at least two compartments 82, 86 for receiving laundry treatment agents such as washing and/or rinsing agents and a container 84 for receiving a softener.

Figure 3:
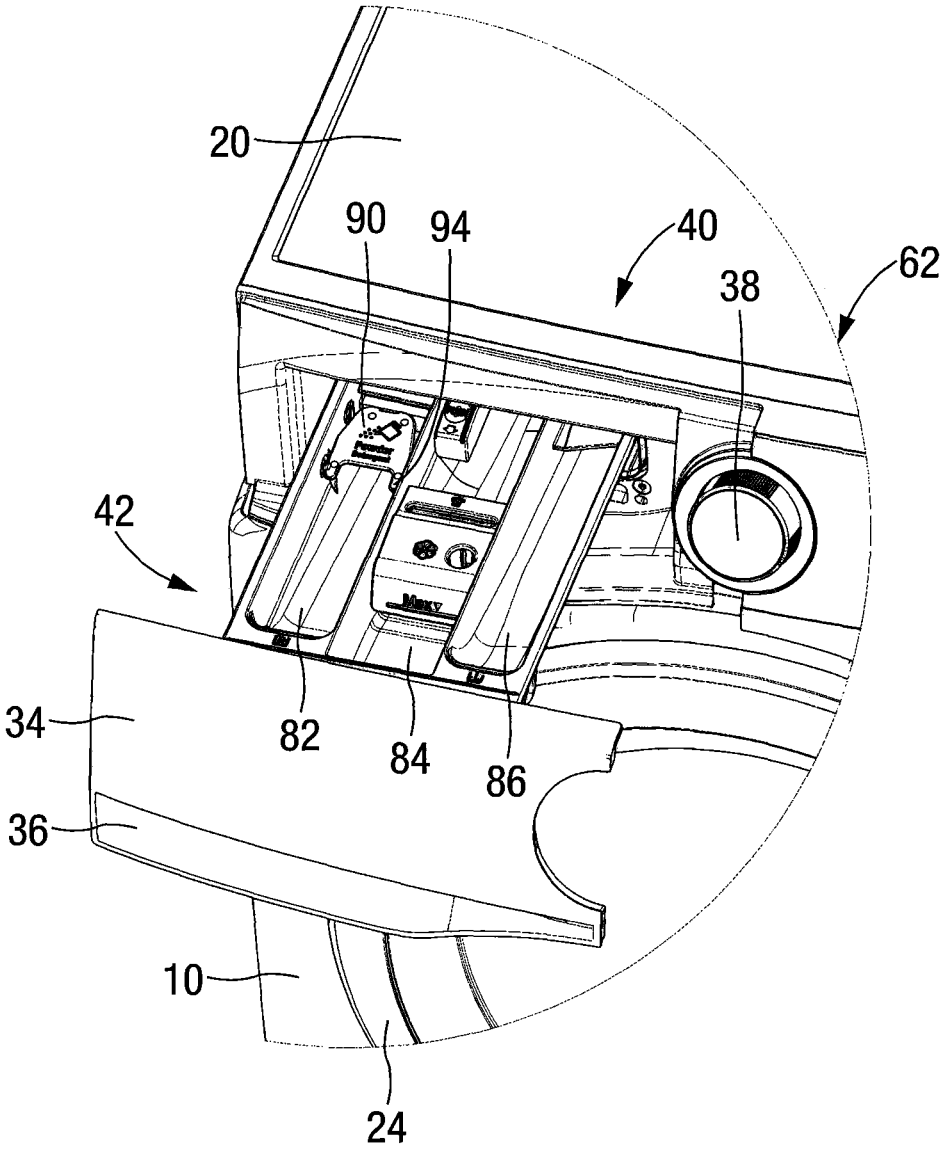
FIG. 3 shows a closer view of the washing machine with the drawer extracted.

Laundry treatment machine 2 comprises a water supply circuit which can be built according to the known art and preferably is arranged at the upper part of the laundry treatment machine 2 and is suited to supply water into the tub. It advantageously comprises at least one supply valve which is properly controlled, opened and closed, during the washing/rinsing cycle. In FIG. 3, a closer view of the laundry treatment machine with the extracted drawer 42 is shown. The drawer 42 is configured to supply detergents and/or rinsing or other laundry treatment agents into tub. The extractable drawer 42 comprises various compartments 82, 84, 86 suited to be filled with washing products, especially a detergent, and at least one a rinse additive, especially a fabric softener. Compartment 82 is preferably adapted to receive liquid or powder detergent. Compartment 84 is preferably adapted to receive softener. Compartment 86 is preferably adapted to receive a laundry treatment agent in the form of liquid.

The extractable drawer 42 may alternatively/additionally comprise still further compartments suited to be filled with other type of rinse additives, such as fabric conditioners, waterproofing agents, fabric enhancers, rinse sanitization additives, chlorine-based additives, i.e. products which are suitable to be used in the rinsing phase of the washing program. The drawer 42 preferably comprises a compartment configured to accept liquid laundry treatment agent, especially liquid detergent.

Compartment 82 preferably comprises a flap 90 which acts as a closing means or element for this compart and which is arranged in compartment 82 at two hinges 92, 94. Flap 90 is shown in an upward position. The flap 90 is configured to move to the position facing bottom part of compartment 82, when it is filled with liquid laundry treatment agent; on the other hand, the flap 90 is movable/removable to open the chamber on the discharge side when the powder detergent is inserted on said compartment.

Figure 4:
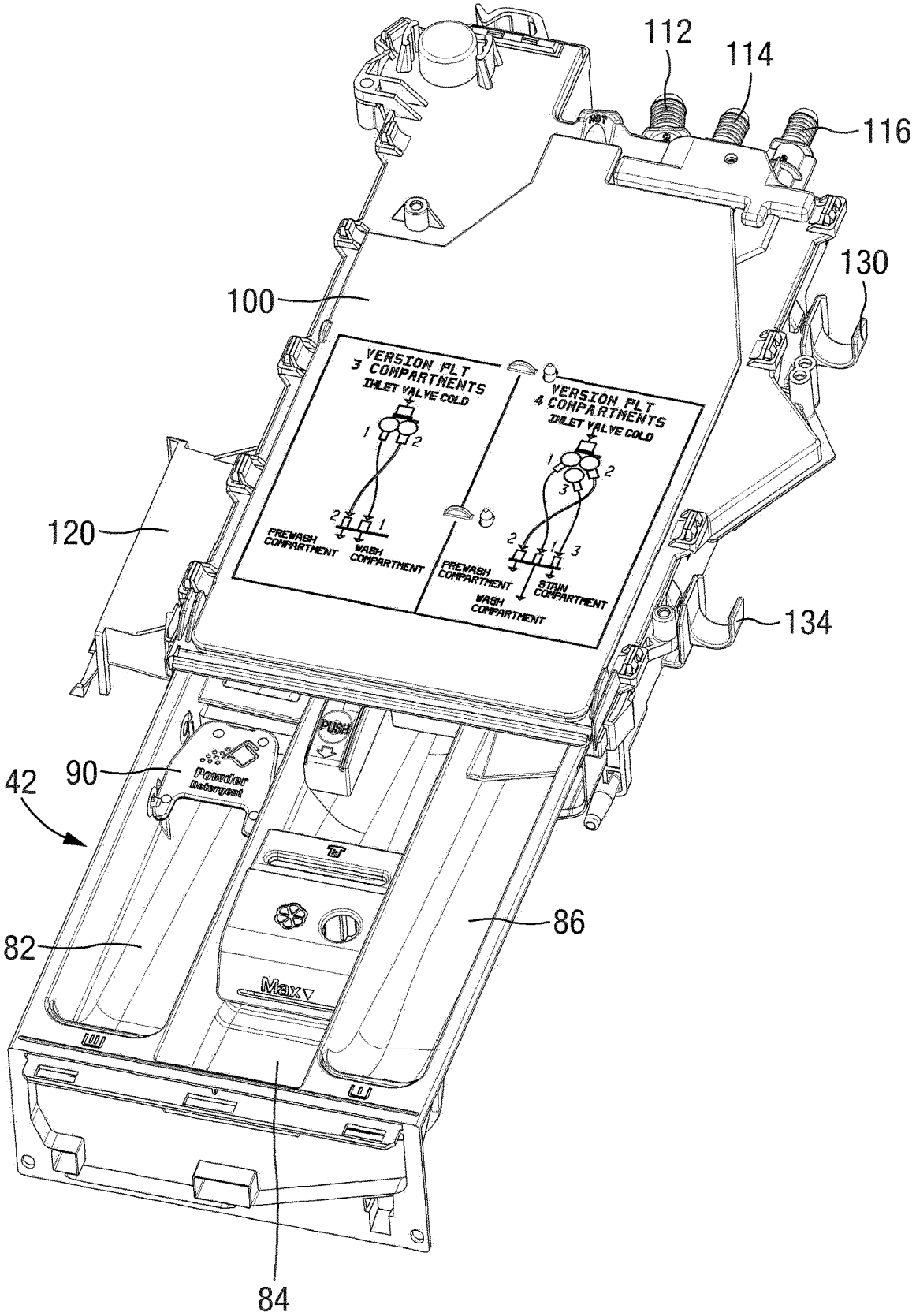
FIG. 4 shows the drawer extracted from a drawer housing in a perspective view.
Figure 5:
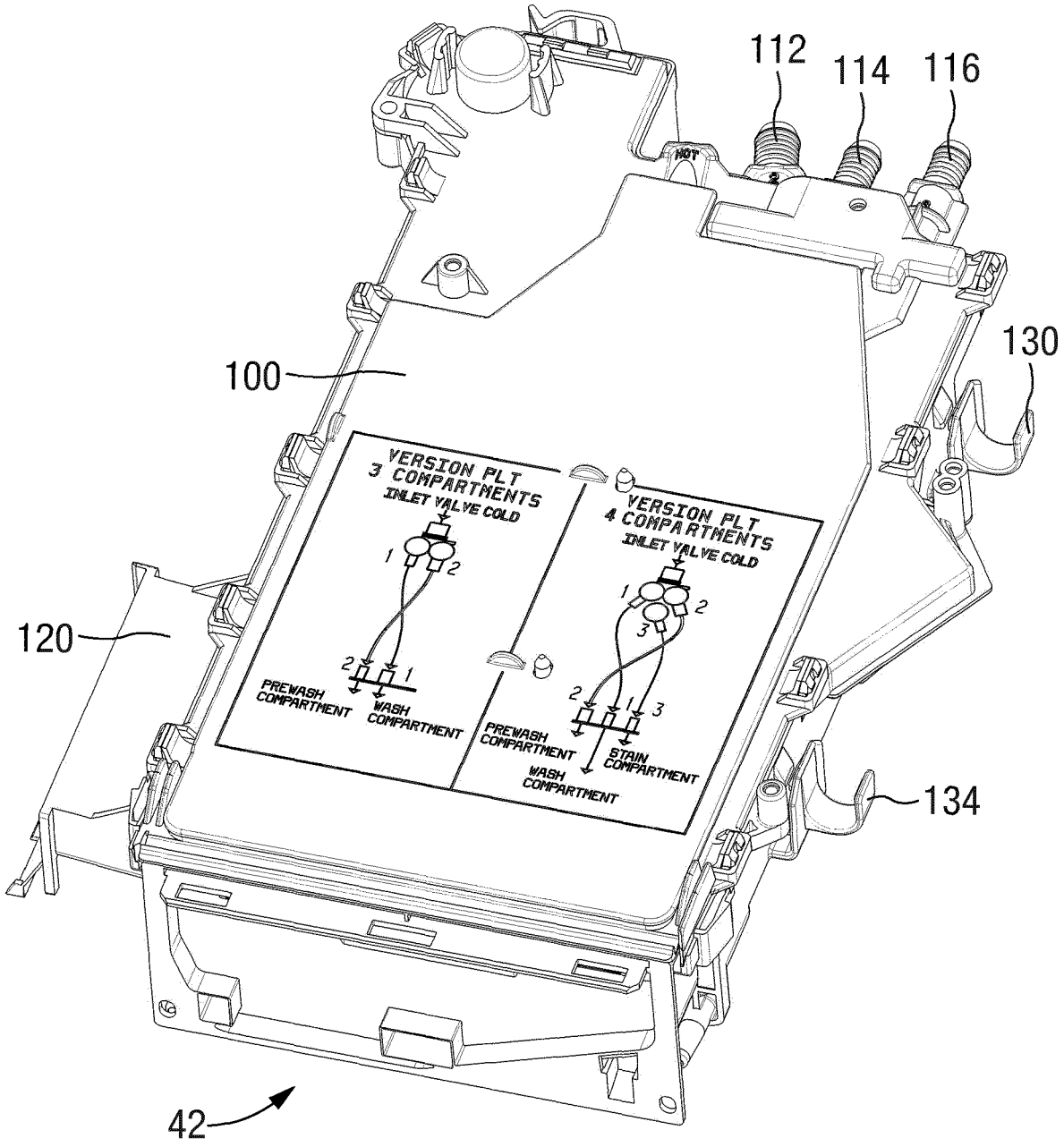
FIG. 5 shows the drawer inserted in the drawer housing in the same perspective view of FIG. 4.
Figure 6:
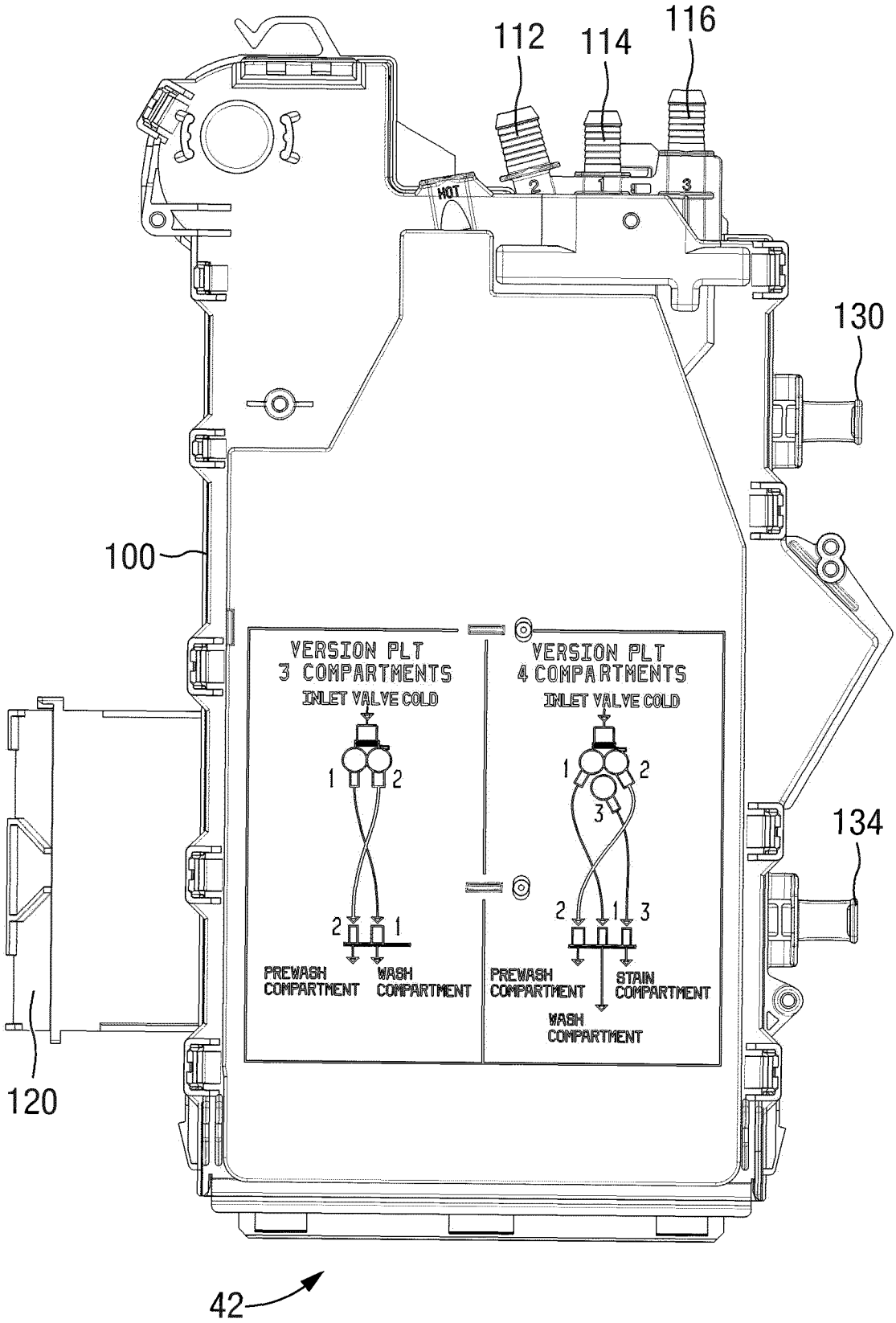
FIG. 6 shows the drawer and the drawer housing shown in FIG. 5 in a top view.

In FIG. 4, in a perspective view a drawer housing 100 of appliance 2 with extracted drawer 42 is shown, whereby the front plate 34 of drawer 42 is removed. A flushing device is integrated into drawer housing which preferably comprises three inlets 112, 114, 116 connected with three respective valves for connection to the water mains and pipes for channeling water or washing liquid into the tub. An overflow channel 120 is provided to allow water flow from the flushing device (in case of sudden overflow, i.e. valve damages) to the bottom side of the washing machine. In FIG. 5, drawer housing 100 is shown with drawer 42 fully inserted in a perspective view and in FIG. 6 in a top view.

Figure 7:
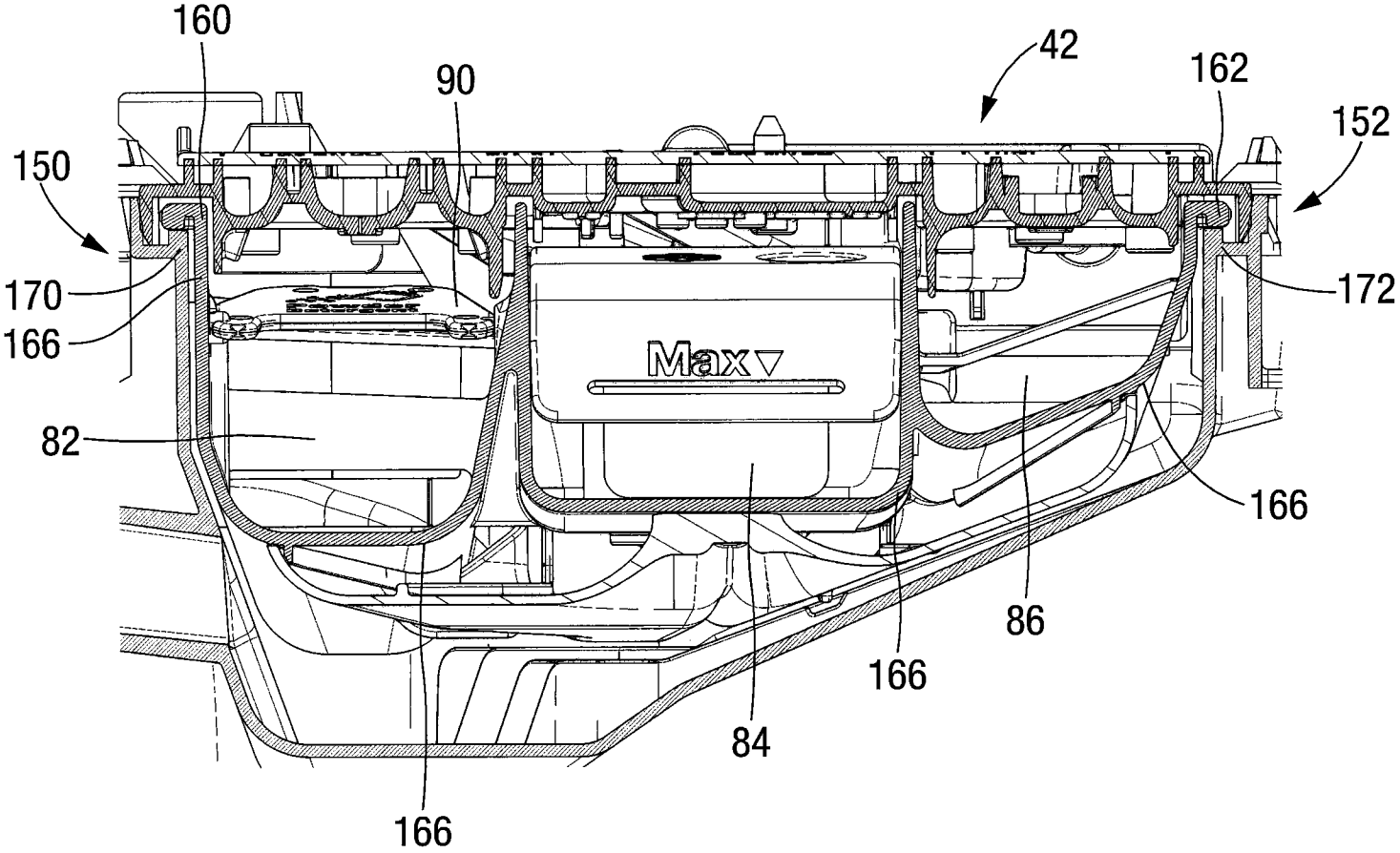
FIG. 7 shows a cross section of drawer and drawer housing.

In FIG. 7, a section through drawer 42 inserted in drawer housing 100 is shown. Drawer 42 preferably on each side 150, 152 comprises a sliding element 160, 162, respectively. Sliding elements 160, 162 which preferably are lateral edges of drawer 42 are preferably built integrally with a drawer body 166. Sliding element 160 bears on a guiding element 170 which is part of drawer housing 100. Sliding element 162 bears on a guiding element 172 which is part of drawer housing 100. For receiving sliding element, a slot 182 is realized in drawer housing 100.

Figure 8:
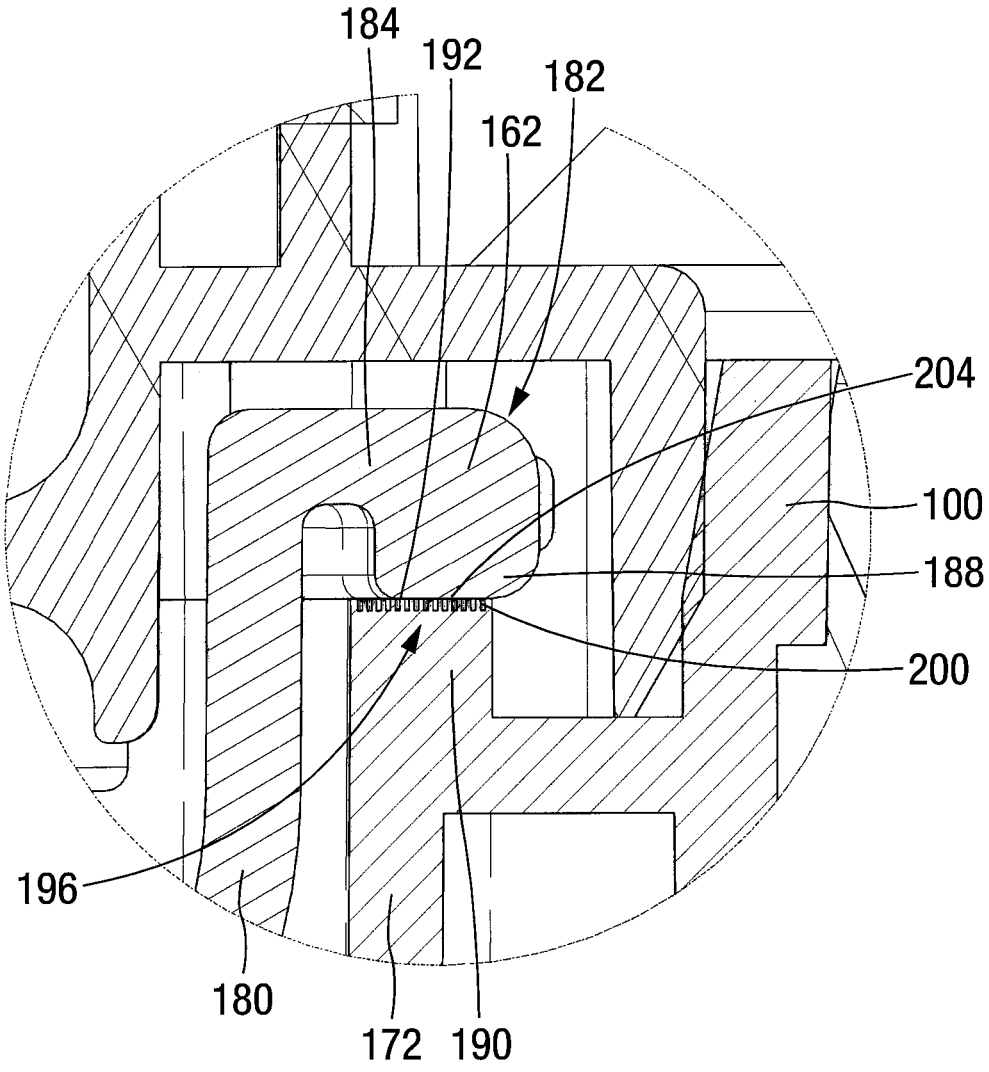
FIG. 8 shows an enlarged view of drawer and drawer housing in a preferred variant.

As can be seen in FIG. 8, sliding element 162 is in its cross section preferably shaped as a hook or lug with a first straight wall part 180, a lateral part 184 which is oriented perpendicular to wall part 180, and an end part 188 which bends back and perpendicular to lateral part 184. In the mounted state, end part 188 is directed outwards from wall part 180 with respect to drawer 42.

Guiding element 172 preferably comprises a rail part 190 with an essentially even surface 192. Said surface can preferably extended along the entire deep of the drawer housing; alternatively, said surface can extend only at certain portions of the drawer housing deep, interrupted by suitable recesses; in any case, the surface 192 comprises one or several contact area in which the contact surface of the end part of the drawer slides during the extraction or insertion of said drawer with respect to the drawer housing.

According to the present invention, the friction between the drawer and the drawer housing is reduced through the increasing of the roughness obtained by recesses provided in the contact surface between the sliding elements 162 and the guiding element 172.

According to the embodiment shown in FIG. 8, the recesses provided on the contact surface 192 consists of a plurality of grooves 196 which respectively have a rectangular cross section. The grooves have preferably a width between 50 μm and 2 mm. Preferably, grooves 196 are built as microstructures. Surface 192 of guiding element provides a contact surface 200 for sliding element 162. The contact surface 200 is built by the even parts between the grooves 196. By the presence of the grooves, 196, the contact surface 200 is reduced compared to the case of a corresponding (same area) flat contact surface 200.

According to the preferred embodiment shown in FIG. 8, sliding element 162 provides a contact surface 204 for guiding element 172. In the present preferred embodiment, contact surface 204 is flat and does not provide grooves/microstructures. The reduction of the surface area of contact surface 200 due to the grooves reduces the friction between respective sliding element 162 and guiding element 172. According to an alternative embodiment, only or also the contact surface 204 can have an increase roughness through recesses/grooves/microstructures provided therein; in case of the preferred embodiment in which both the contact surfaces 192 and 204 are provided with recesses/grooves/microstructures, those provided on the surface 192 could be preferably disposed with a different orientation with respect to the orientation of those provided on the surface 204, for example one perpendicularly the other.

On the opposite side of drawer 42, sliding element 160 and guiding element 170 are preferably arranged in a mirror symmetric way to sliding element 172 and guiding element 162. Drawer 42 therefore essentially rests on and is carried by slide elements 160, 162.

Figure 9:
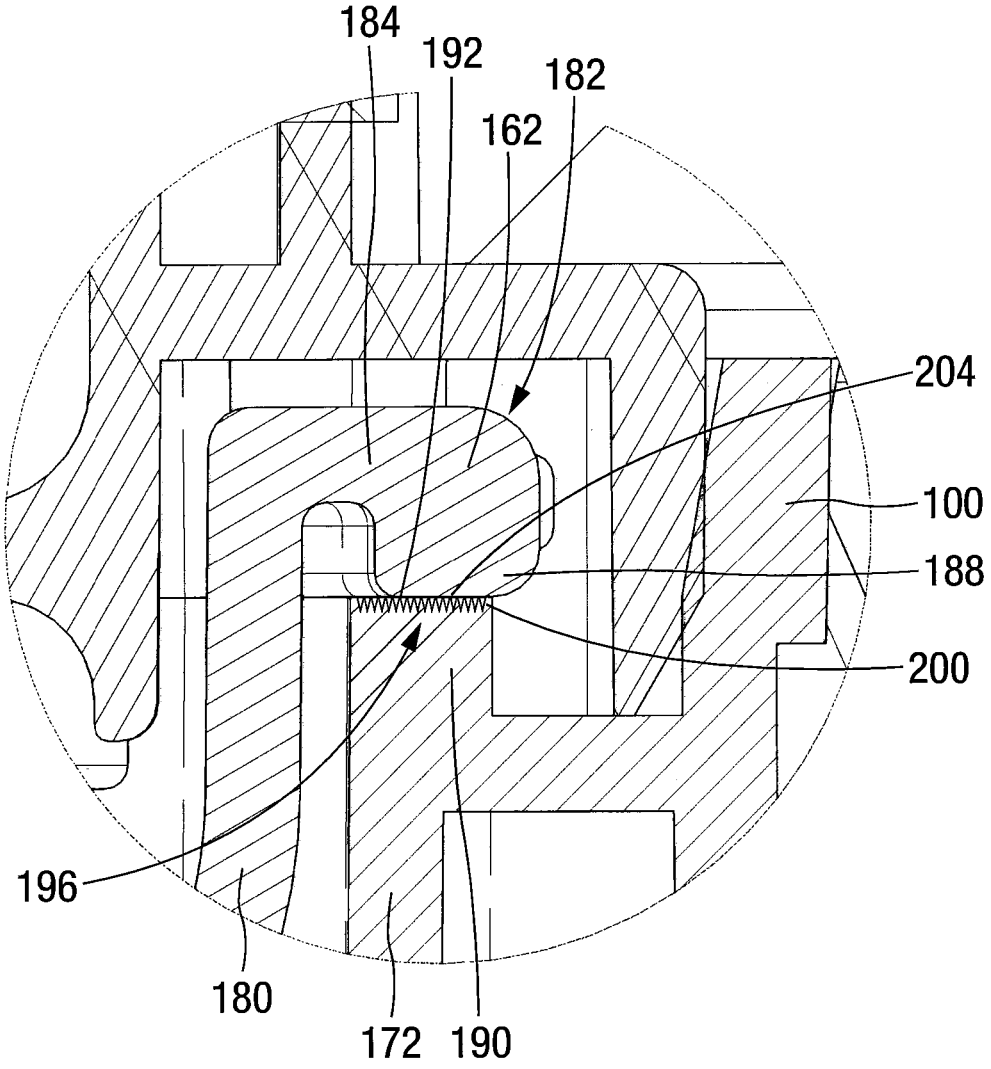
FIG. 9 shows an enlarged view of drawer and drawer housing in a further preferred variant with grooves with a triangular cross section.

In the preferred embodiment shown in FIG. 9, sliding element 172 and guiding element 162 are built as shown in FIG. 8 with the exception that the grooves 196 respectively comprise a triangular cross section, whereby these grooves have an outer contour of a zig-zag line or saw-tooth shape. The contact surface 200 therefore essentially is provided by small tips or bumps at the top between the triangular recesses, which can lead to a string reduction of the contact surface 200.

Figure 10:
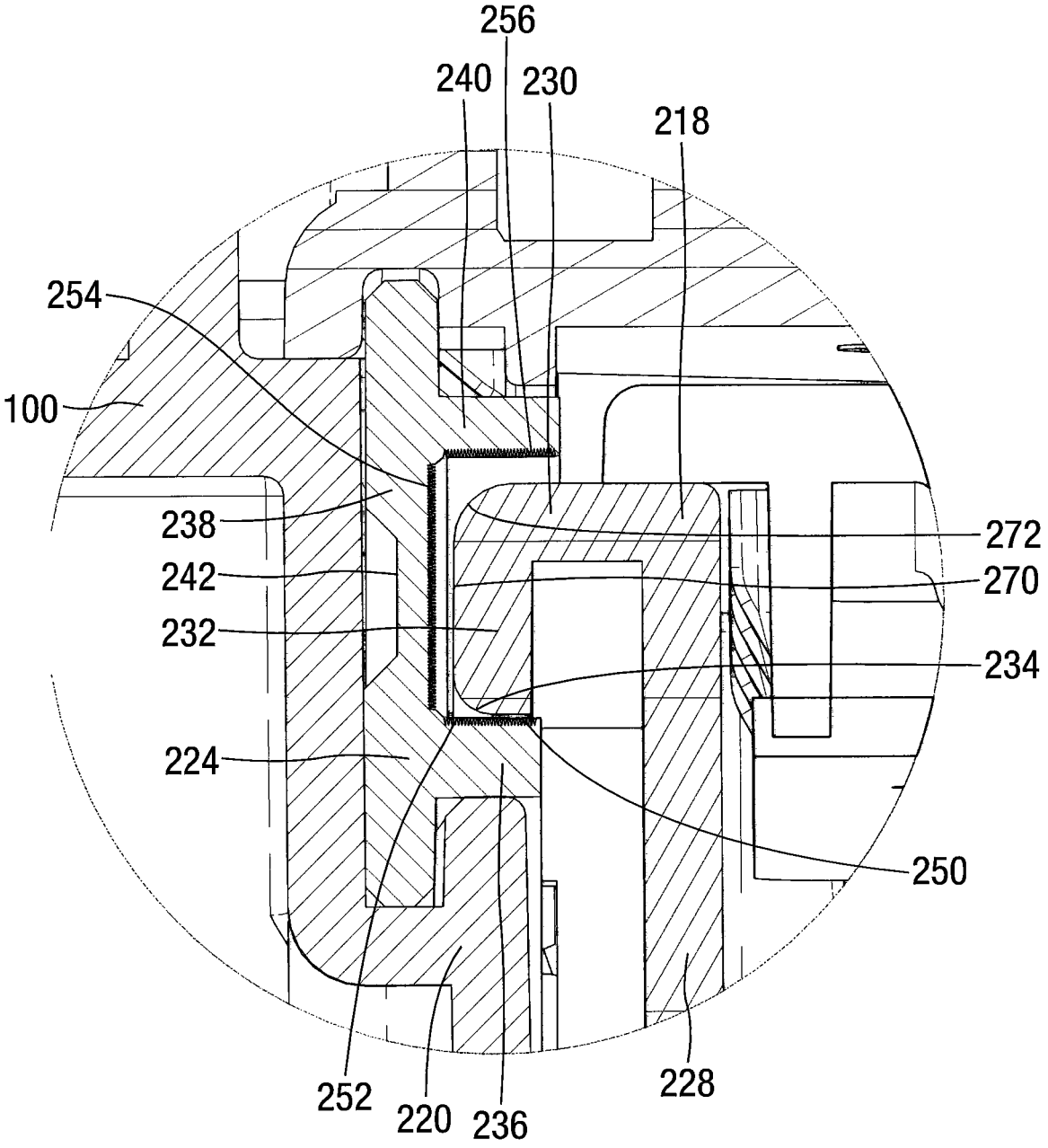
FIG. 10 shows an enlarged view of drawer and drawer housing in still a further preferred variant.

A further preferred embodiment is shown in FIG. 10. Drawer 42 comprises two sliding elements of which one sliding element 228 is shown in a detailed view. Sliding element 228 bears on a guiding element 224, which is arranged on a mounting part 220 of drawer housing 100. Preferably, guiding element is arranged in form-locking manner in drawer housing 100. Guiding element 224 preferably comprises a C-like section or cross section with two parallel parts 236, 240 and a main part 238 perpendicular to said parallel parts for receiving at least partly said sliding element 228. Main part 238 comprises a cut 242 with a trapezoid-like cross section. Sliding element 228 preferably comprises a rounded edge 234 and a contact surface 250 where it is in contact with the guiding element 224. Guiding element 224 comprises three contact surfaces 250, 254, 256 which respectively comprise recesses which are shaped in a triangle form in their cross section as described in connection with FIG. 9. The drawer 42 rests slideable on lower contact surface 250 on which it is pressed due to gravity. Contact surface 254 gets in touch with a contact surface 270 of sliding element 228 when drawer is moving to the outside (left) in the Figure. A contact surface 256 with increased roughness is provided on the guiding element 224 opposite to guiding contact surface 254, i.e. the same guiding element 224 comprises two opposing contact surfaces 254, 256. In this way, the same type of guiding element 224 can be used for both sides of drawer 42. There is no need to manufacture a separate left and right guiding element.

Figure 11:
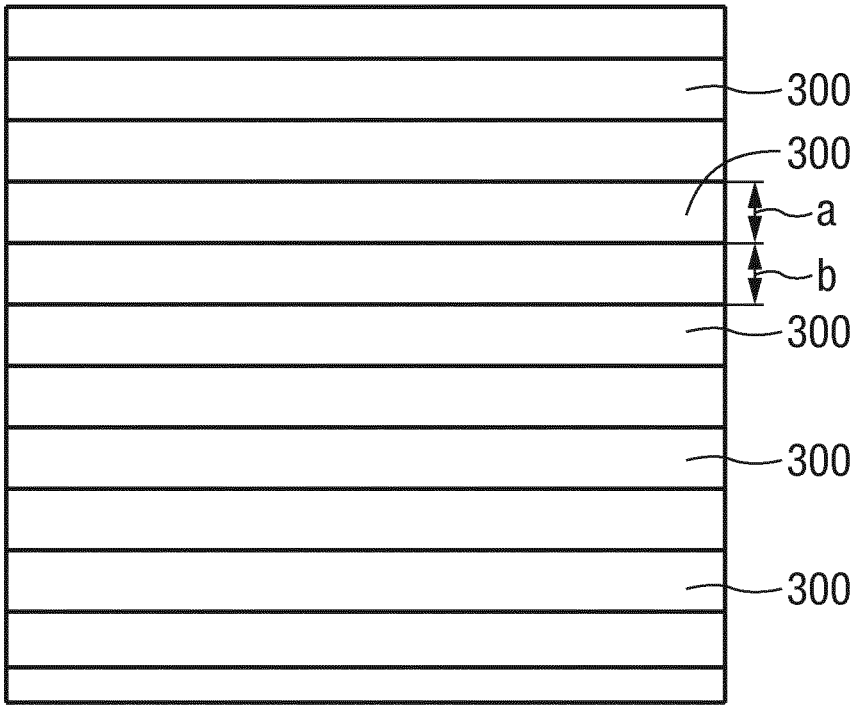
FIG. 11 shows grooves for a contact surface in a first embodiment in a top view.
Figure 12:
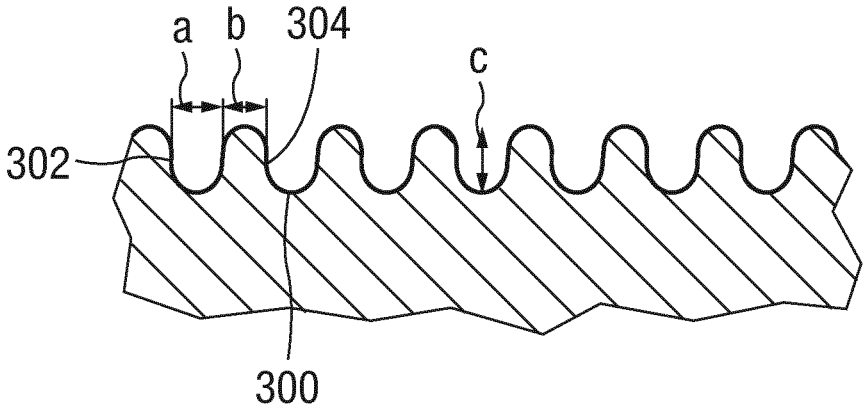
FIG. 12 shows the grooves according to FIG. 11 in a cross section.
Figure 13:
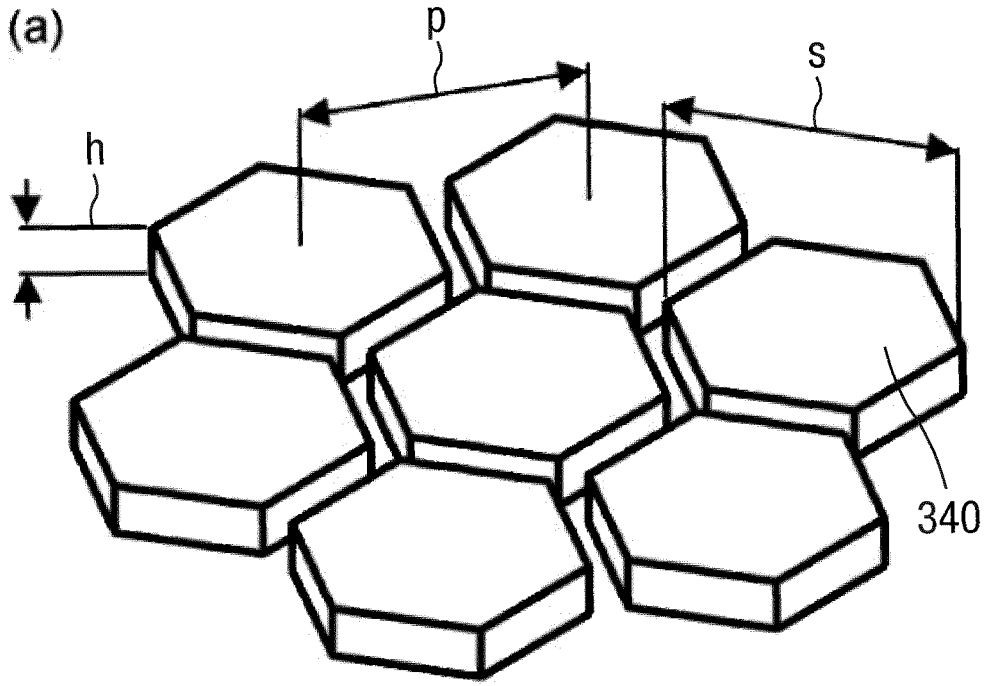
FIG. 13 shows micro pillars for a contact surface in a preferred embodiment in a perspective view.
Figure 14:
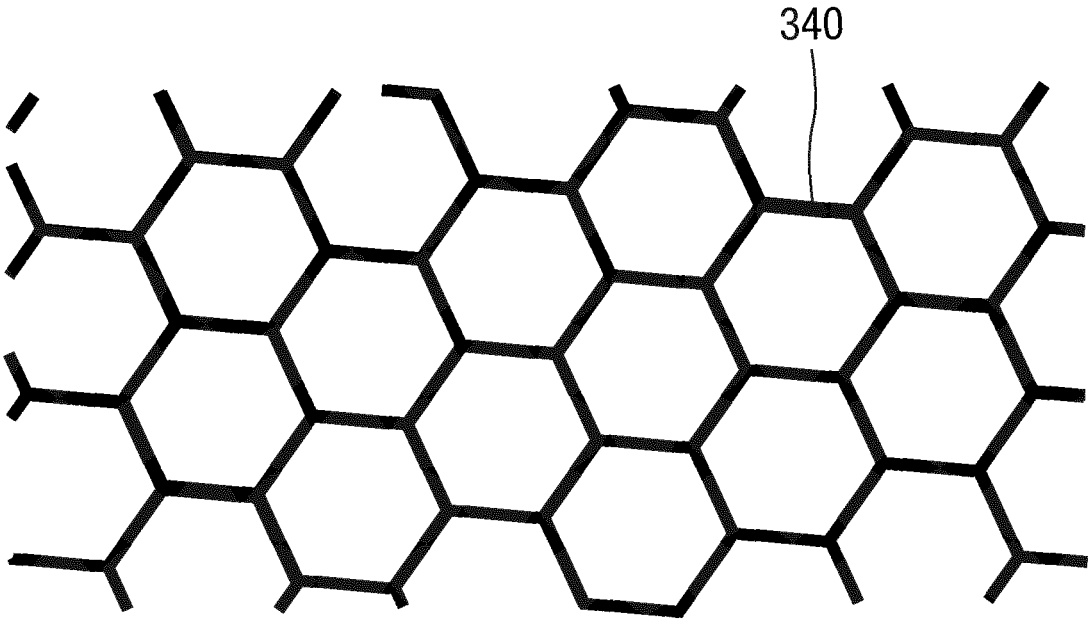
FIG. 14 shows the micro pillars according to FIG. 13 in a top view.

In FIG. 11, a preferred embodiment of grooves 300 are shown in a top view and in FIG. 12 in a cross section. As can be seen especially in FIG. 12, these grooves have a cross section with parallel walls 302, 304 ending in a semi-circle 306. Their width a in preferred embodiment is 140 μm and their respective distance preferably is 125 μm. There preferable depth c is 200 μm The recesses preferably can also be realized by providing as micro-pillars 340 in the contact surface as shown in FIGS. 13 and 14. The micro-pillars 340 shown in FIGS. 13 and 14 preferably are hexagonal-shaped/have hexagonal cross-sections.

In an alternative, preferred embodiment, the micro-pillars 340 can have a rectangular or circular cross-sections. For each of these shapes/cross sections, the micro-pillars 340 are preferably provided in a regular grid.

For all preferred embodiments of the recesses described above, the ratio of the effective contact surface to a full flat contact surface is preferably between 10% and 80%, more preferably between 50% and 70%

The invention thus conceived can be subjected to numerous modifications and variants all falling within the scope of the inventive concept. In addition, all details can be replaced by other technically equivalent elements. In practice, all the materials used, as well as the shapes and contingent dimensions, may vary depending on the requirements without departing from the scope of protection of the following claims.

The invention especially comprises any geometry (micro or macrostructures) designed to reduce the contact surface between the drawer and the drawer housing.

The invention claimed is:

1. A household appliance, comprising:

a drawer housing having at least one guiding element; and a retractable drawer arranged in the drawer housing, the drawer comprising at least one sliding element slideably arranged on the at least one guiding element such that the sliding element and the guiding element provide respective contact surfaces for each other;

wherein the guiding element and/or the sliding element comprises at least in a portion of the respective contact surface a roughness increased by recesses that reduce a size of the respective contact surface.

2. The household appliance according to claim 1, wherein the recesses (196) are only arranged on the respective guiding element.

3. The household appliance according to claim 1, wherein the recesses at least partially comprise grooves.

4. The household appliance according to claim 3, wherein the grooves have a width between 50 μm and 2 mm.

5. The household appliance according to claim 3, wherein at least a subset of the grooves has a rectangular cross section.

6. The household appliance according to claim 3, wherein at least a subset of the grooves has a cross section comprising parallel walls ending in a semi-circle.

7. The household appliance according to claim 3, wherein at least a subset of the grooves has a triangular cross section.

8. The household appliance according to claim 1, wherein at least some of the grooves comprise grid of micro-pillars.

9. The household appliance according to claim 8, wherein the micro-pillars comprise at least one of a circular, rectangular or hexagonal cross section.

10. The household appliance according to claim 1, wherein the guiding element comprises two contact surfaces for a respective sliding element.

11. The household appliance according to claim 1, comprising two groups of guide elements arranged on respective opposite sides of the drawer housing.

12. The household appliance according to claim 1, wherein the respective guiding element is integrated with the drawer housing.

13. The household appliance according to claim 1, wherein the guiding element is arranged on a seat of the drawer housing.

14. The household appliance according to claim 13, wherein the guiding element comprises a C shaped section with two parallel parts and a main part perpendicular to the parallel parts (236, 240) configured to at least partly receive the sliding element.

15. The household appliance according to claim 1, wherein the household appliance comprises a laundry treatment machine.

* * * * *